US010620579B2

(12) United States Patent
Hagimoto

(10) Patent No.: US 10,620,579 B2
(45) Date of Patent: Apr. 14, 2020

(54) CONTACTING DEVICE TO REDUCE FLUCTUATION OF CONTACT PRESSURE AGAINST ROTATING BODY

(71) Applicant: KONICA MINOLTA, INC., Chiyoda-ku, Tokyo (JP)

(72) Inventor: Noritoshi Hagimoto, Toyohashi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/968,097

(22) Filed: May 1, 2018

(65) Prior Publication Data

US 2019/0129351 A1 May 2, 2019

(30) Foreign Application Priority Data

May 1, 2017 (JP) ..... 2017-091355

(51) Int. Cl.
*G03G 21/00* (2006.01)
*G03G 21/16* (2006.01)

(52) U.S. Cl.
CPC ..... *G03G 21/0017* (2013.01); *G03G 21/0029* (2013.01); *G03G 21/1647* (2013.01)

(58) Field of Classification Search
CPC ..... G03G 21/0011; G03G 21/0017; G03G 21/0029; G03G 21/007; G03G 2221/0005; G03G 2221/0026; G03G 2221/0068; G03G 2221/0089; G03G 2221/1618; G03G 2221/1627
See application file for complete search history.

(56) References Cited

U.S. PATENT DOCUMENTS 3,848,992 A * 11/1974 Smith ..... G03G 21/0017 100/174
5,404,216 A * 4/1995 Numagami ..... G03G 21/007 15/256.5
2016/0209799 A1* 7/2016 Kubota ..... G03G 21/0029

FOREIGN PATENT DOCUMENTS

| | | | |
|---|---|---|---|
| JP | H09325659 | A | 12/1997 |
| JP | 2003280475 | A | 10/2003 |
| JP | 2007323026 | A | 12/2007 |
| JP | 2008111972 | A | 5/2008 |
| JP | 2013218209 | A | 10/2013 |

OTHER PUBLICATIONS

Machine translation of JP2007323026. Dec. 13, 2007. (Year: 2007).*

* cited by examiner

*Primary Examiner* — Carla J Therrien
(74) *Attorney, Agent, or Firm* — Cantor Colburn LLP

(57) ABSTRACT

A cleaning blade is a contacting device abutting a photoconductor which is a rotating body. The cleaning blade includes a contacting member that abuts the photoconductor, a supporting member that supports the contacting member, and a holding member that holds the supporting member. The supporting member supports the contacting member in a part protruding from the holding member. The holding member includes an upper surface on the side where the contacting member abuts the photoconductor and a lower surface on the opposite side of the upper surface. The holding member holds the supporting member with a supporting region away from the tip portion to the read end side. It is possible to reduce the fluctuation of the contact pressure abutting the rotating body.

18 Claims, 17 Drawing Sheets

FIG. 15

| | |
|---|---|
| CONTACTING MEMBER | MATERIAL: URETHANE RUBBER<br>THICKNESS:2mm、L: 5mm、W: 340mm |
| SUPPORTING MEMBER | MATERIAL: SUS304<br>THICKNESS:80 μm W:340mm |
| HOLDING MEMBER | MATERIAL: SECC METAL PLATE<br>THICKNESS: 2 μm、W: 340mm |
| FIX METHOD OF CONTACTING MEMEBER AND SUPPORTING MEMBER | USING THERMOPLASTIC ADHESIVE<br>BOND ENTIRE LOWER SURFACE OF CONTACT MEMBER |
| FIX METHOD OF SUPPORTING MEMBER AND HOLDING MEMBER | FIX AT MULTIPLE FIXATION POINTS USING SPOT WELDING<br>Distance in the longitudinal direction of each of the fixing portions: 4 mm<br>(The distance between the fixing portion of the longitudinal direction end portion and the longitudinal direction end portion of the support member is 2 mm) |
| CONDITION SET | CONTACT PRESSURE 30 N/m<br>EFFECTIVE CONTACT ANGLE ( θ ) : 15° |
| IMAGE SUPPORTING MEMBER | ORGANIC PHOTORECEPTOR |

CONTACTING DEVICE TO REDUCE FLUCTUATION OF CONTACT PRESSURE AGAINST ROTATING BODY

CROSS REFERENCE TO RELATED APPLICATION

The present application claims priority under 35 U.S.C. § 119 to Japanese patent Application No. 2017-091355 filed on May 1, 2017, the entire content of which is incorporated herein by reference.

BACKGROUND

Technological Field

The present invention relates to a contacting device and an image forming apparatus including the contacting device. More particularly, the present invention relates to a contacting device abutting a rotating body and an image forming apparatus provided with the contacting device.

Description of the Related Art

As electrophotographic image forming apparatuses, there are an MFP (Multi Function Peripheral) equipped with a scanner function, a facsimile function, a copying function, a function as a printer, a data communication function, and a server function, and a facsimile machine, a copying machine, a printer, and so on.

An image forming apparatus generally forms an image on a sheet by the following method. An image forming apparatus forms an electrostatic latent image on an image carrying member and develops the electrostatic latent image using a developing device to form a toner image. Next, the image forming apparatus transfers the toner image to a sheet, and fixes the toner image on the sheet by the fixing device. Some image forming apparatuses form a toner image on a photoreceptor and use a primary transfer roller to transfer the toner image to an intermediate transfer belt. The toner image on the intermediate transfer belt is secondarily transferred onto a sheet by using a secondary transfer roller.

An image forming apparatus is provided with a cleaning blade for removing the remaining toner from the image carrying member, by abutting against the rotating image carrying member. Generally, the cleaning blade is made of a polyurethane elastomer. Since the polyurethane elastomer has an appropriate elasticity, the cleaning blade made of the polyurethane elastomer has a good cleaning property.

On the other hand, a cleaning blade made of polyurethane elastomer has the following problems.

A cleaning blade is always in contact with the image carrying member. When the polyurethane elastomer deteriorates with time, permanent distortion (permanent set) occurs in the cleaning blade due to the force received from the image carrying member. There is a problem that the pressure (contact pressure) at which the cleaning blade contacts the image carrying member decreases due to the permanent distortion. The decrease in the contact pressure of the cleaning blade causes cleaning defects. In order to compensate for the decrease in contact pressure of the cleaning blade due to aged deterioration of the polyurethane elastomer, it is conceivable to set the contact pressure at the beginning of use of the cleaning blade high. In this case, the high contact pressure of the cleaning blade interfered with the rotation of the image carrying member, resulting in an increase in the torque required to rotate the image carrying member.

In addition, the performance of the cleaning blade made of polyurethane elastomer changed greatly depending on the environment. That is, the contact pressure increased under high temperature environments, the torque required for the rotation of the image carrying member increased, and the contact pressure became low under low temperature environments. Therefore, contact pressure was set to a high value that can ensure necessary contact pressure under low temperature environments. As a result, the torque required to rotate the image carrying member was increased.

Furthermore, due to the characteristics of the polyurethane elastomer, when the edge portion in contact with the image carrying member of the cleaning blade is drawn to the downstream side in the rotation direction of the image carrying member, the cleaning blade deforms, and the contact pressure increases. As a result, the torque required to rotate the image carrying member was increased.

Techniques capable of solving the problems of the cleaning blade made of polyurethane elastomer as described above are disclosed in the following Documents 1 and 2 and so on. The conventional cleaning blades in the following Documents 1 and 2 include an elastic body made of urethane rubber or the like abutting an image carrying member, a metal blade spring supporting the elastic body, and a metal holding plate that holds the blade spring. The tip of the blade spring protrudes from the holding plate, and the elastic body is supported by a portion protruding from the holding plate in the blade spring. The blade spring is deformed by the force received from the image carrying member via the elastic body. In this deformation, the fulcrum is the part located at the tip of the holding plate in the blade spring (at the end on the side where the blade spring protrudes, and the elastic body exists).

In the cleaning blades of the following Documents 1 and 2, an elastic body that abuts an image carrying member and a blade spring that supports an elastic body are formed as separate members. Therefore, an optimum material can be selected as a material of the blade spring, from the viewpoint of less deterioration over time and less change in performance due to environment. A configuration of the conventional cleaning blade is also disclosed in the following Documents 3 to 5 and so on.

DOCUMENT(S)

Document(s) Related to Patent(s)

[Document 1] Japanese Unexamined Patent Publication No. 2007-323026

[Document 2] Japanese Unexamined Patent Publication No. 2008-111972

[Document 3] Japanese Unexamined Patent Publication No. HEI 9-325659

[Document 4] Japanese Unexamined Patent Publication No. 2003-280475

[Document 5] Japanese Unexamined Patent Publication No. 2013-218209

In conventional cleaning blades, the blade spring is fixed to the holding plate in various ways, such as screwing, welding, bonding, or applying double-sided tape. In particular, when a fixing method such as screwing or welding is used, the blade spring is fixed to the holding plate in a fixed area at a distance from the tip of the holding plate, for the convenience of fixing the blade spring to the holding plate.

The blade spring is not fixed to the tip of the holding plate. Therefore, the portion of the blade spring existing between the fixed area and the tip of the holding plate is free to deform according to the force received from the image carrying member via the elastic body. The part of the blade spring that acts as a fulcrum changes. In other words, the free length of the blade spring which is the length from the fulcrum to the tip of the blade spring changes. As a result, the fluctuation (variation) of the contact pressure of the cleaning blade was increased.

If the contact pressure is too high, an increase in rotational torque of the image carrying member and a decrease in life due to an increase in the amount of depletion of the image carrying member occur. If the contact pressure is too low, poor cleaning of the image carrying member occurs.

Even if fixing methods other than screw fastening and welding are used as the fixing method of the blade spring, when the blade spring is fixed to the holding plate in a fixed area at a distance from the tip of the holding plate, the fluctuation of the contact pressure of the cleaning blade was increased in the same way.

The problem that the fluctuation of the contact pressure is large is not a problem of only the cleaning blade, but a problem occurring in the contacting device abutting the rotating body in general.

SUMMARY

An object of the present invention is to provide a contacting device capable of reducing the fluctuation of contact pressure abutting against a rotating body, and an image forming apparatus including the contacting device.

To achieve at least one of the abovementioned objects, according to an aspect of the present invention, a contacting device abutting a rotating body reflecting one aspect of the present invention comprises a contacting unit which abuts the rotating body, a supporting unit for supporting the contacting unit, and a holding unit for holding the supporting unit, wherein the supporting unit supports the contacting unit by a protruding part which protrudes from the holding unit, the holding unit includes a first surface existing on the side in a direction where the contacting unit abuts the rotating body and a second surface existing on the opposite side of the first surface, and the holding unit holds the supporting unit in a supporting region apart from an end portion of a distal end side to a rear end side on the second surface, where the end side of a protruding direction of the protruding part in the contacting device is defined as the distal end side of the contacting device, and the end side in a direction opposite to the protruding direction in the contacting device is the rear end side of the contacting device.

According to another aspect of the present invention, an image forming apparatus comprises: the rotating body, the contacting device, and a housing for fixing the contacting device, wherein the contacting device is fixed to the housing at the rear end side with respect to an end portion of the distal end side in the supporting region.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 15 is a table showing conditions for experiments in an embodiment of the present invention.

DETAILED DESCRIPTION OF EMBODIMENTS

Hereinafter, one or more embodiments of the present invention will be described with reference to the drawings. However, the scope of the invention is not limited to the disclosed embodiments.

In the following embodiments, a case where the image forming apparatus on which the contacting device is mounted is an MFP will be described. The image forming apparatus on which the contacting device is mounted may be a facsimile machine, a copying machine, a printer, or the like, in addition to the MFP. In addition, the contacting device may contact the rotating body, and may be mounted on a device other than the image forming device.

First Embodiment

First, the configuration of the image forming apparatus according to the present embodiment will be described.

Figure 1:
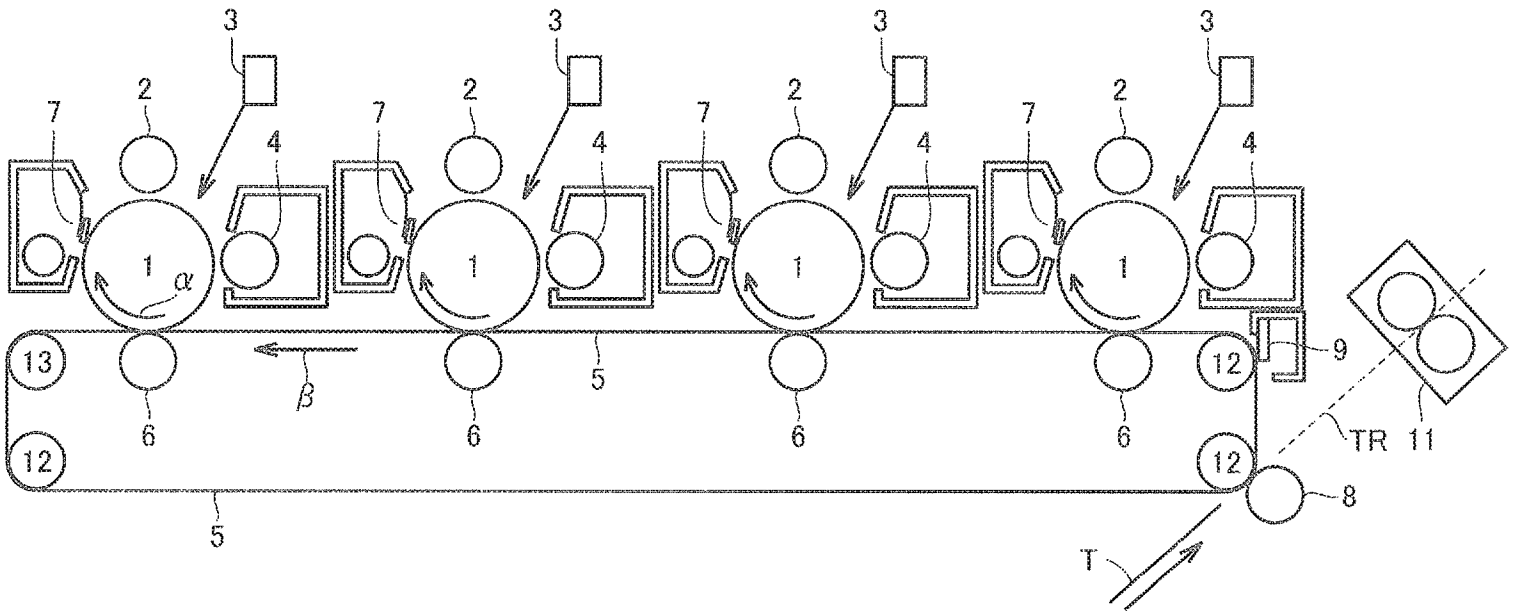
FIG. 1 is a cross-sectional view showing a configuration of a main part of an image forming apparatus according to a first embodiment of the present invention.

FIG. 1 is a cross-sectional view showing a configuration of a main part of an image forming apparatus according to a first embodiment of the present invention.

Referring to FIG. 1, the image forming apparatus in this embodiment is a full-color tandem type image forming apparatus. The image forming apparatus transfers toner images formed on the photoconductors 1 by an electrophotographic image forming process onto a recording medium T such as paper and fixes the image to form an image. The image forming apparatus includes photoconductors 1 (examples of rotating bodies), charging units 2, exposure units 3, developing devices 4, intermediate transfer belt 5, primary transfer rollers 6, photoconductor cleaning units 7, secondary transfer roller 8, intermediate transfer belt cleaning unit 9, fixing unit 11, and supporting rollers 12.

A photoconductor 1, a charging unit 2, an exposure unit 3, a developing device 4, a primary transfer roller 6 and a photoconductor cleaning unit 7 are provided for each color of Y (yellow), M (magenta), C (cyan), and K (toner). A charging unit 2, an exposure unit 3, a developing device 4, and a photoconductor cleaning unit 7 are arranged in this order along the rotation direction of the photoconductor 1, indicated by an arrow $\alpha$ in the periphery of the photoconductor 1. The intermediate transfer belt 5 is provided under the photoconductors 1 and rotates in a direction indicated by an arrow $\beta$. The primary transfer rollers 6 face the photoconductors 1 via an intermediate transfer belt 5.

The secondary transfer roller 8 is disposed downstream of the primary transfer roller 6 of each color for the intermediate transfer belt 5 in the direction of rotation of the intermediate transfer belt 5. The secondary transfer roller 8 faces a predetermined supporting roller 12 with the intermediate transfer belt 5 interposed therebetween. The intermediate transfer belt cleaning unit 9 is disposed at a position downstream of the intermediate transfer belt 5 in the rotational direction of the intermediate transfer belt 5, than the position opposed to the secondary transfer roller 8.

Each of the plurality of supporting rollers 12 is arranged in parallel to each other, and applies a constant tension to the intermediate transfer belt 5. One of the plurality of supporting rollers 12 is rotated and the intermediate transfer belt 5 rotates. The other supporting rollers 12 rotate following the intermediate transfer belt 5. Fixing unit 11 is arranged on the downstream side of the secondary transfer roller 8 in the conveying path TR.

Photoconductor 1 carries an electrostatic latent image on its surface layer. The charging unit 2 uniformly charges the surface of the photoconductor 1. The exposure unit 3 exposes the image corresponding part of the surface of the photoconductor 1 to form an electrostatic latent image. The developing device 4 develops the electrostatic latent image on the surface of the photoconductor 1 with the charged toner by the action of the electric field force. The primary transfer roller 6 transfers the toner image formed on the surface of the photoconductor 1 onto the intermediate transfer belt 5 by the action of electric field force. The photoconductor cleaning unit 7 removes toner remaining on the surface of the photoconductor 1 (transfer remaining toner).

The toner images of each colors of Y, M, C, and K are transferred onto the surface of the intermediate transfer belt 5 so as to be superimposed thereon, and are conveyed to a position facing the secondary transfer roller 8. On the other hand, the recoding medium T is transported along a conveying path TR to a secondary transfer roller 8 by a transporting unit (not shown).

The secondary transfer roller 8 transfers the toner image of YMCK transferred on the surface of the intermediate transfer belt 5 to the recoding medium T under the action of electric field force. The recoding medium T to which the toner image was transferred is heated and pressed by the fixing unit 11. As a result, the toner image is fixed to the recoding medium T. Thereafter, the recoding medium T is conveyed along the conveying path TR and discharged to the outside of the image forming apparatus. The intermediate transfer belt cleaning unit 9 is in contact with the intermediate transfer belt 5 and removes (cleans) the toner (transfer remaining toner) remaining on the surface of the intermediate transfer belt 5.

The above-described configuration of the image forming apparatus is an example. As a structure of a photoconductor, a charging unit, an exposure unit, a developing device, a cleaning unit, a transferring unit, a fixing unit, and the like in the image forming apparatus, well-known electrophotographic techniques may be arbitrarily selected and used.

Subsequently, the configuration of the photoconductor cleaning unit 7 in this embodiment will be described.

Figure 2:
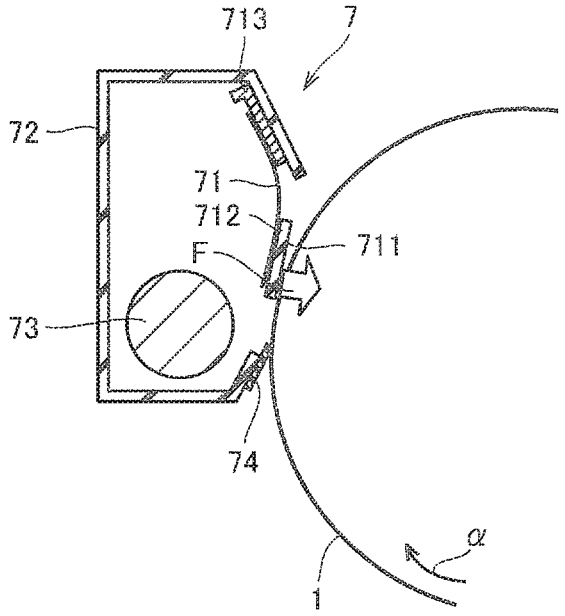
FIG. 2 is a cross-sectional view showing a configuration of a photoconductor cleaning unit 7 in the first embodiment of the present invention.

FIG. 2 is a cross-sectional view showing a configuration of a photoconductor cleaning unit 7 in the first embodiment of the present invention. In FIG. 2, a photoconductor 1 is shown for convenience of explanation.

Referring to FIG. 2, the photoconductor cleaning unit 7 includes a cleaning blade 71 (an example of a contacting device), a housing 72, a screw 73, and a toner sealing member 74. The cleaning blade 71 is in contact with the photoconductor 1 and removes remaining toner which is substances adhering to the surface of the photoconductor 1. The housing 72 accommodates the remaining toner removed by the cleaning blade 71, and accommodates the cleaning blade 71 and the screw 73. The screw 73 conveys the remaining toner removed by the cleaning blade 71 to a waste toner storage box (not shown). By sealing the inside of the housing 72, the toner sealing member 74 prevents the removed remaining toner from scattering around the photoconductor 1 and prevents contamination of the surface of the photoconductor 1.

The cleaning blade 71 includes a contacting member 711 (an example of a contacting unit) abutting photoconductor 1, a supporting member 712 (an example of a supporting unit) supporting the contacting member 711, and a holding member (holding plate) 713 (an example of a holding unit) which holds the supporting member. The holding member 713 is fixed to the housing 72. By the supporting member 712 which acts as a blade spring, the contacting member 711 abuts the photoconductor 1 with the required contact pressure. As a result, the transfer remaining toner on the surface of the photoconductor 1 after the primary transfer is scraped off by the contacting member 711 and removed. The contacting member 711 is in contact with the photoconductor 1 in a direction indicated by an arrow F.

Figure 3:
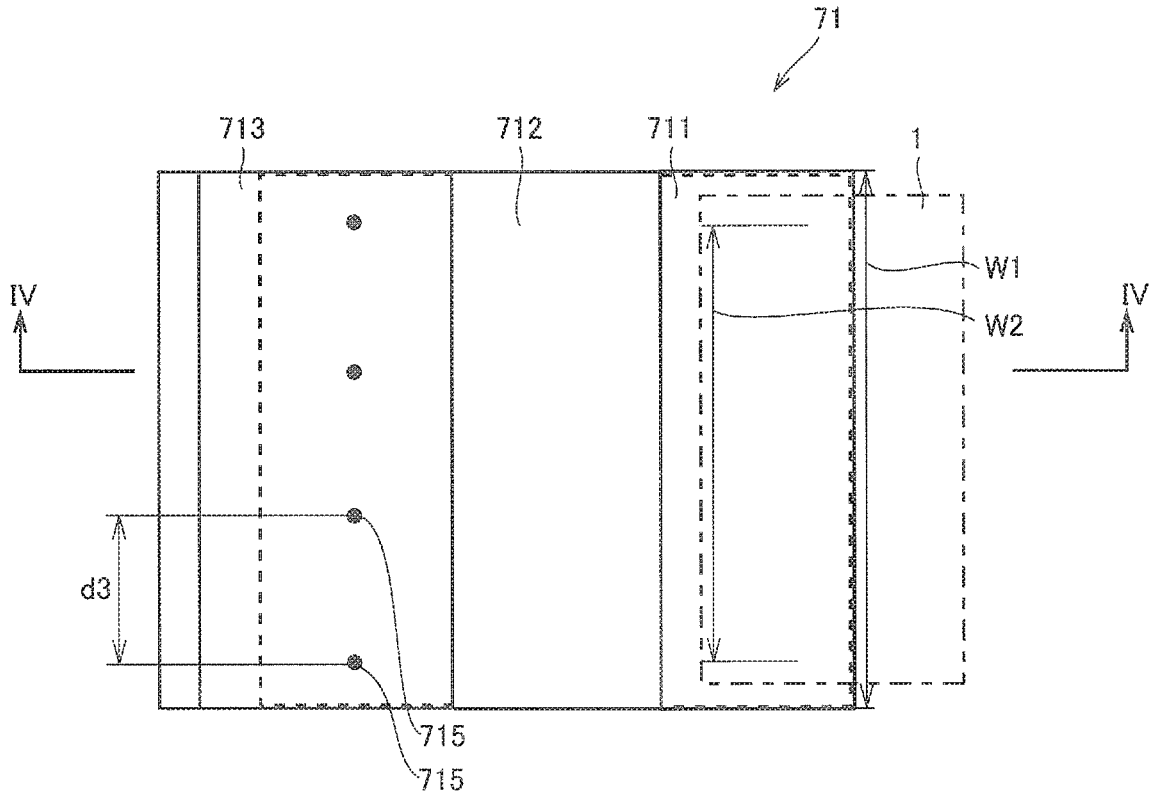
FIG. 3 is a top view showing a configuration of a cleaning blade 71 according to the first embodiment of the present invention.
Figure 4:
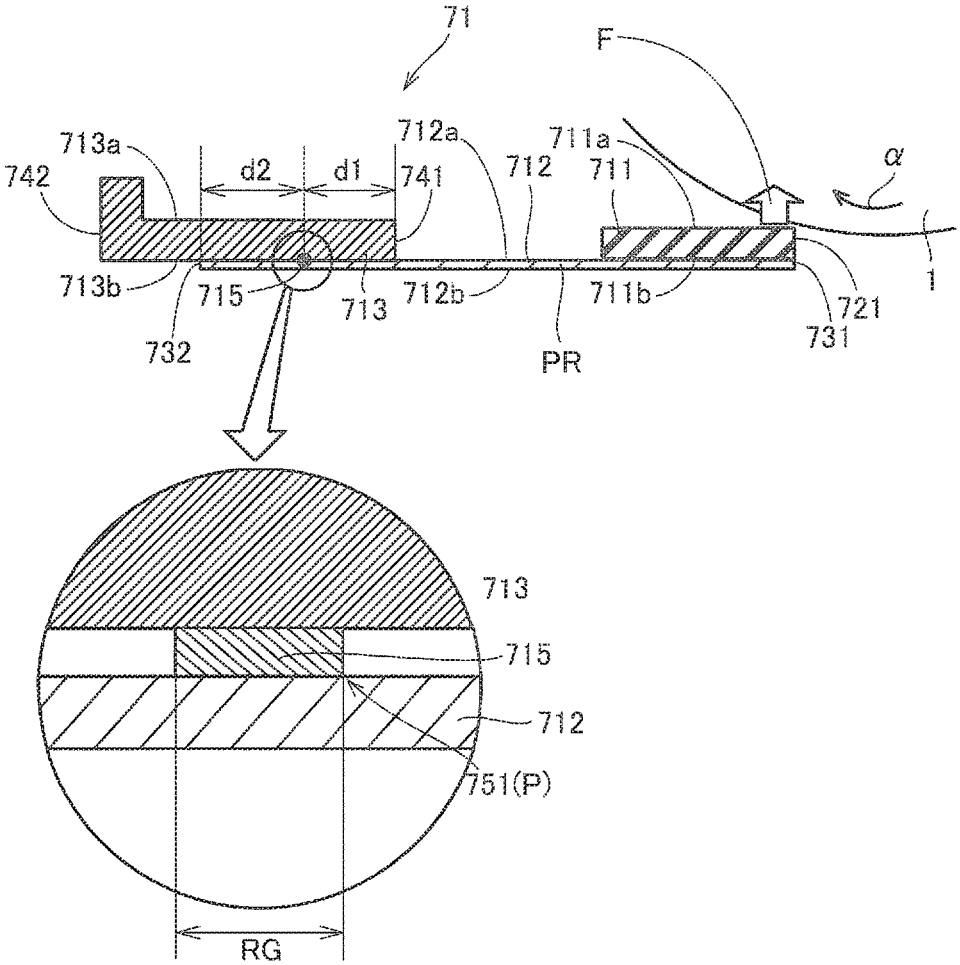
FIG. 4 is an example of a cross-sectional view taken along line IV-IV in FIG. 3.
Figure 5:
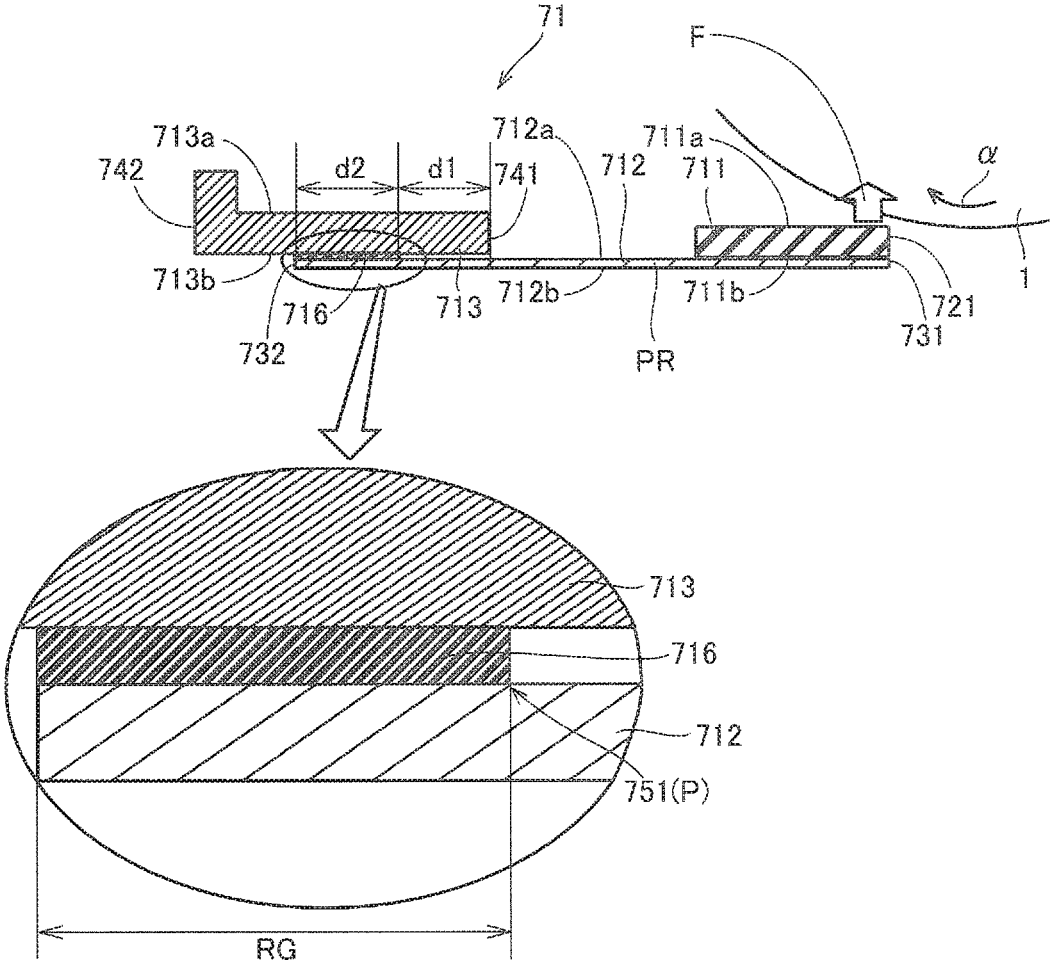
FIG. 5 is another example of a cross-sectional view taken along line IV-IV in FIG. 3.

FIG. 3 is a top view showing a configuration of a cleaning blade 71 according to the first embodiment of the present invention. FIG. 4 is an example of a cross-sectional view taken along line IV-IV in FIG. 3. FIG. 5 is another example of a cross-sectional view taken along line IV-IV in FIG. 3. For convenience of explanation, in FIG. 3 to FIG. 6, the photoconductor 1 is shown, and the supporting member 712 is shown not warped. Actually, the supporting member 712 is warped by the force received from the photoconductor 1.

In the following description, the end side of the protruding direction of protruding part PR in cleaning blade 71 may be referred to as the distal end side. The end side opposite to the protruding direction of the protruding part PR in the cleaning blade 71 may be referred to as the rear end side. Further, the end portion of the protruding direction of the protruding part PR in each member of the cleaning blade 71 may be referred to as the tip portion of the member. The end portion in the direction opposite to the protruding direction of the protruding part PR in each member of the cleaning blade 71 may be referred to as the read end portion of the member.

With reference to FIG. 3 to FIG. 5, the contacting member 711 is plate-like and has a rectangular shape when viewed from above. The contacting member 711 includes an upper surface 711*a* (an example of an abutting surface), and a lower surface 711*b* (an example of a supporting surface) that exists on the opposite side of the upper surface 711*a*. The contacting member 711 abuts the photoconductor 1 near the tip portion 721 of the upper surface 711*a* and is supported by the supporting member 712 on the lower surface 711*b*.

The contacting member 711 is made of an elastic body. Specifically, the contacting member 711 is made of urethane rubber, fluororubber (FKM), styrene butadiene rubber (SBR), acrylonitrile rubber (NBR), or the like. The contacting member 711 is preferably made of a material excellent in abrasion resistance and ozone resistance. The contacting member 711 preferably has a thickness (length in the vertical direction in FIG. 4) of 0.5 or more and 2.0 mm or less.

The length W1 (the length in the rotation axis direction of the photoconductor 1) of the contacting member 711 along the longitudinal direction (longitudinal direction in FIG. 3) of the cleaning blade 71 is longer than the length W2 of the image forming region of the photoconductor 1. A specific length W1 is preferably 5 mm or more and 10 mm or less. When molding the cleaning blade 71 with a metal mold, the thickness and the length W1 of the contacting member 711 may be smaller than the above-mentioned range.

The contacting member 711 is fixed to the supporting member 712 by, for example, an adhesive or a double-sided tape. From the viewpoint of securing the straightness of the supporting member 712, the contacting member 711 is preferably fixed to the supporting member 712 with an adhesive. The adhesive is preferably a thermoplastic adhesive. Further, the contacting member 711 may be fixed to the supporting member 712 by the molten material of the contacting member 711 is poured into a metal mold while the supporting member 712 is fixed to the metal mold of the contacting member 711, when the contacting member 711 is molded. In this case, an adhesive or a double-sided tape is unnecessary.

The position of the tip portion 721 of the contacting member 711 preferably coincides with the position of the tip portion 731 of the supporting member 712. When the tip portion 731 of the supporting member 712 protrudes from the tip portion 721 of the contacting member 711, it is preferable that the supporting member 712 does not contact the photoconductor 1. When the tip portion 721 of the contacting member 711 projects beyond the tip portion 731 of the supporting member 712, it is preferable that the protruding length of the contacting member 711 is 0.5 mm or less. As a result, it is possible to avoid a situation in which the contact pressure to the photoconductor 1 decreases over time due to the deformed contacting member 711 protruding from the tip portion 731 of the supporting member 712.

The supporting member 712 is in the form of a plate and has a rectangular shape when viewed from above. The supporting member 712 includes a protruding part PR protruding from the holding member 713 toward the tip portion 731 side (protruding in the short direction of the cleaning blade 71). The protruding part PR protrudes from the holding member 713 in a direction opposite to the rotation direction (the direction indicated by the arrow $\alpha$) of the photoconductor 1. The supporting member 712 supports the contacting member 711 in the protruding part PR. The supporting member 712 includes an upper surface 712*a* and a lower surface 712*b* that is opposite to the upper surface 712*a*. The lower surface 711*b* of the contacting member 711 is supported by the upper surface 712*a* of the supporting member 712.

The supporting member 712 is made of a metal blade spring or the like. Specifically, the supporting member 712 is made of highly corrosion-resistant stainless steel, phosphor bronze or the like. In particular, stainless steel is preferable because it has high strength and high fatigue strength.

The supporting member 712 preferably has a thickness of not less than 50 μm and not more than 100 μm in order to ensure good followability to the rotation of the photoconductor 1. Further, the supporting member 712 preferably has Young's modulus of 98 GPa or more and 206 GPa or less. It is preferable that the configuration of the supporting member 712 is selected in consideration of the above-mentioned thickness and Young's modulus.

The holding member 713 contains an upper surface 713*a* (an example of a first surface) existing on the side where the contacting member 711 abuts the photoconductor 1 (the direction indicated by the arrow F) and a lower surface 713*b* (an example of a second surface) which exists on the opposite side to the upper surface 713*a*. The holding member 713 further includes a tip portion 741 and a read end portion 742. The holding member 713 holds the supporting member 712 in the supporting region RG located at a position remote from the tip portion 741 to the read end portion 742 side of the lower surface 713*b*.

The supporting member 712 is fixed to the holding member 713 by a method such as welding, adhesive or screwing. FIG. 4 shows a configuration in which the supporting member 712 is fixed to the holding member 713 by spot welding, and a welding portion 715 is present between the supporting member 712 and the holding member 713. FIG. 5 shows a configuration in which the supporting member 712 is fixed to the holding member 713 by an adhesive 716, and the adhesive 716 is present between the supporting member 712 and the holding member 713. In any of the fixing methods, the tip portion 751 of the supporting region RG becomes the fulcrum P, when the supporting member 712 is deflected by the force received from the photoconductor 1.

When the supporting member 712 is fixed to the holding member 713 by welding, the distance d1 between the tip portion 751 of the supporting region RG and the tip portion 741 of the holding member 713 is preferably 1.5 mm or more.

It is preferable that the distance d2 between the tip portion 751 of the supporting region RG and the read end portion 732 of the supporting member 712 is 1.5 mm or more.

Also, when the supporting member 712 is fixed to the holding member 713 by welding, the supporting member 712 is preferably fixed by a plurality of welded parts 715 provided along the longitudinal direction of the cleaning blade 71 (the direction perpendicular to the direction in which the protruding part PR protrudes from the holding member 713, namely, it is the vertical direction in FIG. 3). It is preferable that the interval d3 of each of the plurality of welded parts 715 along the longitudinal direction of the cleaning blade 71 is 2 mm or more and 10 mm or less.

The holding member 713 is made of metal or the like. Specifically, the holding member 713 is made of a steel plate such as SECC (electrogalvanized steel plate). It is preferable that the holding member 713 has a thickness of 1.6 mm or more and 2.0 mm or less, in order to suppress the deformation of the holding member 713 due to the pressure or the external force applied to the cleaning blade 71 and to ensure the strength capable of securing the high edge straightness of the cleaning blade 71.

The distance between the photoconductor 1 and the contacting member 711 is defined by the position at which the cleaning blade 71 is fixed to the housing 72 and the angle of the cleaning blade 71 with respect to the housing 72. The free length L of the cleaning blade 71 described later is defined by the position at which the supporting member 712 is installed on the holding member 713. Further, the deflection amount of the supporting member 712 is defined by the position at which the cleaning blade 71 is fixed to the housing 72.

Next, the effect of the cleaning blade 71 in the present embodiment will be described.

Figure 6:
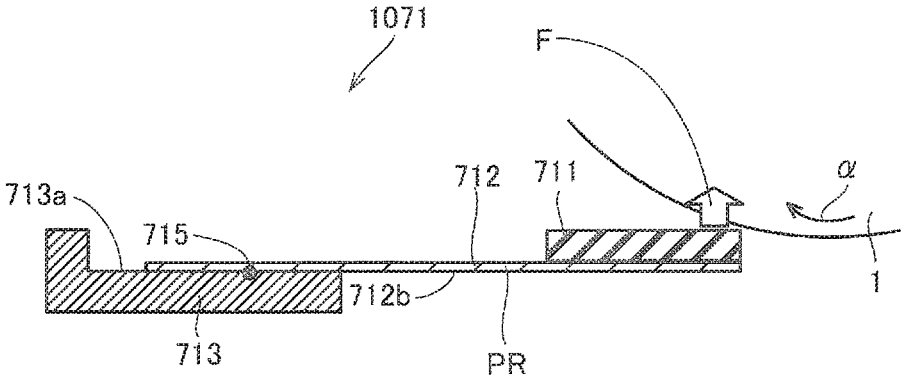
FIG. 6 is a cross-sectional view showing a configuration of a cleaning blade 1071 in a comparative example.

FIG. 6 is a cross-sectional view showing a configuration of a cleaning blade 1071 in a comparative example.

Referring to FIG. 6, according to the cleaning blade 1071 in the comparative example, the holding member 713 holds the lower surface 712*b* of the supporting member 712 at the upper surface 713*a* which is the surface existing on the side where the contacting member 711 abuts the photoconductor 1 (the direction indicated by the arrow F). This point is different from the cleaning blade 71 in this embodiment.

Figure 7:
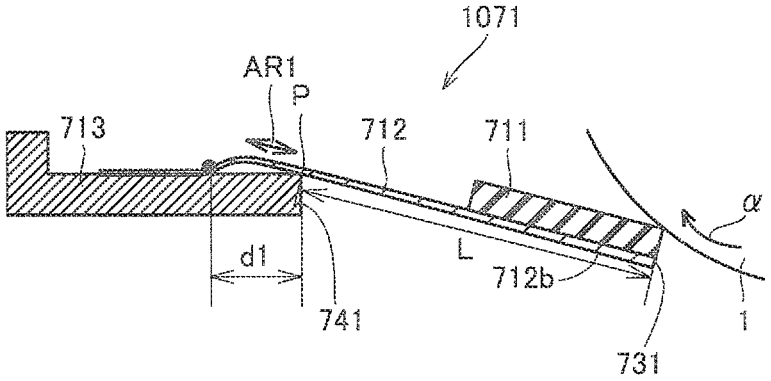
FIG. 7 is a cross-sectional view showing behavior of a cleaning blade 1071 in a comparative example.

FIG. 7 is a cross-sectional view showing behavior of the cleaning blade 1071 in a comparative example.

Referring to FIG. 7, let fulcrum P be the fulcrum when supporting member 712 deflects under force from photoconductor 1. Let the distance from fulcrum P to tip portion 731 of supporting member 712 be free length L. The free length L is an important parameter for determining the contact pressure to the photoconductor 1 of the cleaning blades 71 and 1071, together with the thickness of the supporting member 712, Young's modulus and the amount of biting into the photoconductor 1 and the like.

In the cleaning blade 1071 of the comparative example, the contacting member 711 receives a force from the photoconductor 1. The tip portion 741 of the holding member 713 comes into contact with the lower surface 712*b* of the supporting member 712. With the position of the supporting member 712 in contact with the tip portion 741 of the holding member 713 as the fulcrum P, the supporting member 712 flexes. A part of the supporting member 712 existing within the distance d1 between the tip portion 751 of the supporting region RG and the tip portion 741 of the holding member 713 is not held by the holding member 713. Therefore, the supporting member 712 deforms freely as indicated by an arrow AR1. As a result, the part of the supporting member 712 existing within the distance d1 freely deforms due to the force that the contacting member 711 receives from the photoconductor 1, and the free length L of the supporting member 712 fluctuates. That is, since the free length L fluctuates according to the bending state of the supporting member 712, the fluctuation of the contact pressure to the photoconductor 1 of the cleaning blade 71 is large.

Here, the effect of the size of the distance d1 on the cleaning blade 71 in the cleaning blade 1071 of the comparative example will be described in detail.

Figure 8A:
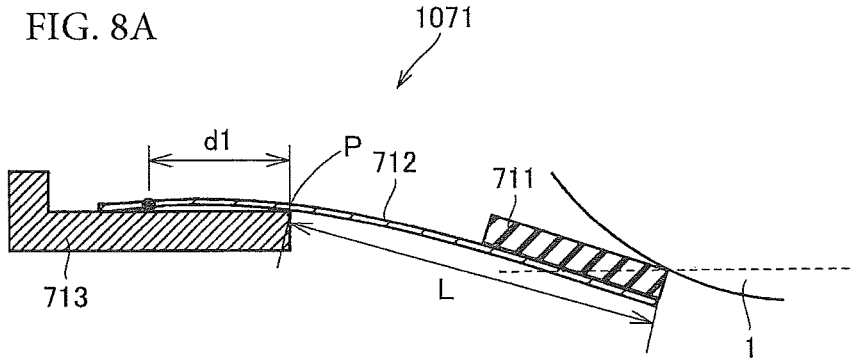
FIG. 8A and FIG. 8B are a cross-sectional view for explaining a problem that can occur when the distance d1 is large in the cleaning blade 1071 of the comparative example.
Figure 8B:
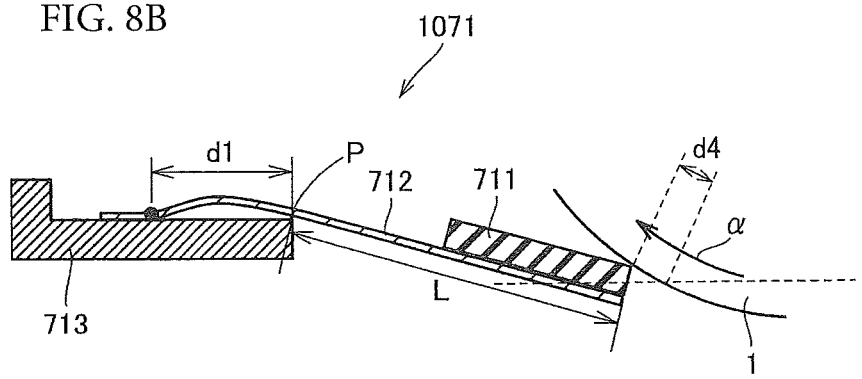

FIG. 8A and FIG. 8B are a cross-sectional view for explaining a problem that can occur when the distance d1 is large in the cleaning blade 1071 of the comparative example. FIG. 8A shows a case where rotation of the photoconductor 1 is stopped. FIG. 8B shows a case where the photoconductor 1 is rotating.

Referring to FIG. 8A and FIG. 8B, when the distance d1 is large, since the length of the freely deformable portion of the supporting member 712 is large, the contacting member 711 is more likely to be drawn into the rotation of the photoconductor 1. As a result, the abutting position of the contacting member 711 to the photoconductor 1 moves by the distance d4 to the downstream side of the rotation direction (the direction indicated by the arrow $\alpha$) of the photoconductor 1, when the photoconductor 1 is rotating (FIG. 8B), as compared with the case where the rotation of the photoconductor 1 is stopped (FIG. 8A). As a result, free length L becomes short, and contact pressure to photoconductor 1 increases. In addition, the effective contact angle (the angle of the contacting member 711 with respect to the tangent line in the rotational direction of the photoconductor 1) increases.

As described above, when the distance d1 is large, the contact force and the effective contact angle of the contacting member 711 to the photoconductor 1 increase. As a result, the peak pressure applied to the contacting portion in the photoconductor 1 becomes high, and the torque necessary for rotationally driving the photoconductor 1 increases. As this torque increases, the power to be supplied to the motor by the image forming apparatus increases, leading to an increase in size and an increase in cost. In addition, if the contact force of the contacting member 711 to the photoconductor 1 increases, the amount of depletion of the photoconductor 1 with respect to the traveling distance (total number of revolutions) of the photoconductor 1 increases, causing the life of the photoconductor 1 to decrease.

Figure 9A:
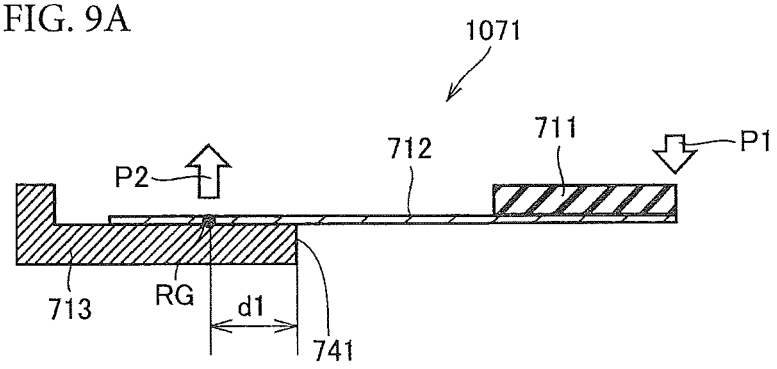
FIG. 9A and FIG. 9B are a cross-sectional view for explaining a problem that can occur when the distance d1 is small in the cleaning blade 1071 of the comparative example.
Figure 9B:
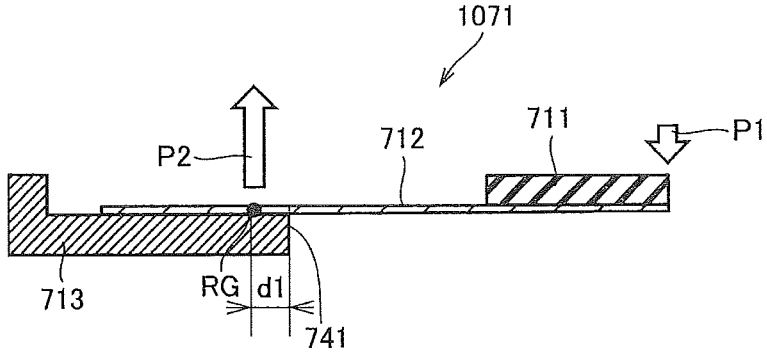

FIG. 9A and FIG. 9B are a cross-sectional view for explaining a problem that can occur when the distance d1 is small in the cleaning blade 1071 of the comparative example. FIG. 9A shows the configuration of the cleaning blade 1071 when the distance d1 is large. FIG. 9B shows the configuration of the cleaning blade 1071 when the distance d1 is small.

Referring to FIG. 9A and FIG. 9B, when a contact pressure P1 is added from the photoconductor 1 to the contacting member 711, a force P2 is added to the supporting region RG (the fixed position of the supporting member 712), with the tip portion 741 of the holding member 713 as fulcrum P. With the principle of leverage, the force that the point of application is closer to fulcrum has a greater force on the point of application. Therefore, if the contact pressure P1 applied to the contacting member 711 is the same, the force P2 applied to the supporting region RG becomes larger when the distance d1 is smaller than when the distance d1 is large. As a result, when the distance d1 is small, the supporting member 712 is easily peeled from the holding member 713 by the force P2 applied to the supporting region RG.

Even if the strength of fixing the supporting member 712 to the holding member 713 is increased, a large force P2 is still applied to the supporting region RG. For this reason, a force exceeding the yielding point is applied to a part of the supporting member 712 existing near the tip portion 741 of the holding member 713, and the supporting member 712 may be damaged.

Figure 10:
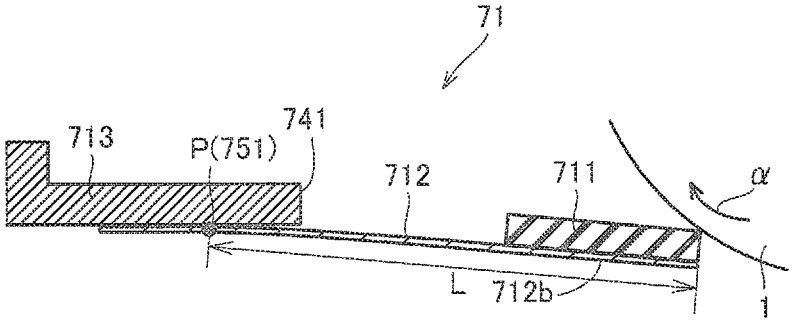
FIG. 10 is a cross-sectional view showing the behavior of the cleaning blade 71 according to the first embodiment of the present invention.

FIG. 10 is a cross-sectional view showing the behavior of the cleaning blade 71 according to the first embodiment of the present invention.

With reference to FIG. 10, according to this embodiment, the above-described problem of the cleaning blade 1071 of the comparative example can be solved. In the cleaning blade 71 according to the present embodiment, the supporting region RG in which the holding member 713 holds the supporting member 712 is present on the lower surface 713*b*. The lower surface 713*b* exists on the side opposite to the upper surface 713*a* existing on the side where the contacting member 711 abuts the photoconductor 1. Therefore, even when the contacting member 711 receives a force from the photoconductor 1, the tip portion 741 of the holding member 713 and the lower surface 712*b* of the supporting member 712 do not come into contact. The supporting member 712 deflects with the tip portion 751 of the supporting region RG as a constant fulcrum P, to become away from the holding member 713. Therefore, the free length L of the supporting member 712 does not fluctuate due to the force that the contacting member 711 receives from the photoconductor 1, and the fluctuation of the contact pressure to the photoconductor 1 of the cleaning blade 71 can be suppressed. As a result, an increase in the torque required to rotate the photoconductor 1 can be suppressed, and a reduction in the life of the photoconductor 1 can be suppressed.

In addition, contact pressure to photoconductor 1 is determined by free length L. Therefore, the contact pressure to the photoconductor 1 realized by the cleaning blade 71 is higher than the contact pressure to the photoconductor 1 obtained by the cleaning blade 1071 of the comparative example, in the case where the overall length in the short direction of the cleaning blade 71 of this embodiment is the same as the overall length in the short direction of the cleaning blade 1071 of the comparative example. As a result, according to the present embodiment, it is possible to shorten the entire length of the cleaning blade 71, and it is possible to reduce the size of the cleaning blade 71. When the total length of the holding member 713 in the short direction is increased, the rigidity of the cleaning blade 71 can be improved, and the robustness can be improved.

By setting Young's modulus of the supporting member 712 to 206 GPa or less, it is possible to prevent the contact pressure to the photoconductor 1 from being high with respect to the deflection amount of the supporting member 712. In addition, it is possible to suppress the fluctuation amount of the contact pressure to the photoconductor 1, when the amount of biting of the supporting member 712 into the photoconductor 1 is fixed. On the other hand, by setting Young's modulus of the supporting member 712 to 98 GPa or more, contact pressure to the photoconductor 1 can be ensured even if the deflection amount of the supporting member 712 is small. Also, it is possible to avoid the situation where the state of contact with the photoconductor 1 and the effective contact angle become unstable, depending on the driving condition of the photoconductor 1.

Similarly, by setting the thickness of the supporting member 712 to 100 μm or less, it is possible to prevent the contact pressure to the photoconductor 1 from being high with respect to the amount of deflection of the supporting member 712. In addition, it is possible to suppress the fluctuation amount of the contact pressure to the photoconductor 1, when the amount of biting of the supporting member 712 into the photoconductor 1 is fixed. On the other hand, by setting the thickness of the supporting member 712 to 50 μm or more, it is possible to ensure contact pressure to the photoconductor 1, even if the deflection amount of the supporting member 712 is small. Also, it is possible to avoid the situation where the state of contact with the photoconductor 1 and the effective contact angle become unstable, depending on the driving condition of the photoconductor 1.

Further, by setting the distance d1 between the tip portion 751 of the supporting region RG and the tip portion 741 of the holding member 713 to be 1.5 mm or more, the welding position can be kept away from the tip portion 741 of the holding member 713, in the case of fixing by spot welding. Therefore, it is easy to perform welding uniformly.

Figure 11:
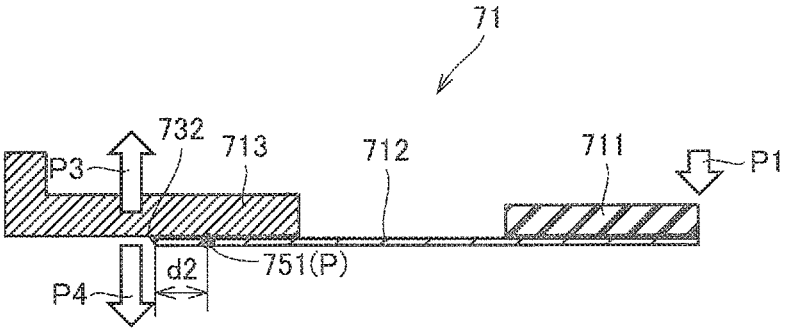
FIG. 11 is a cross-sectional view for explaining the effect of making the distance d2 equal to or greater than 1.5 mm in the first embodiment of the present invention.

FIG. 11 is a cross-sectional view for explaining the effect of making the distance d2 equal to or greater than 1.5 mm in the first embodiment of the present invention.

Referring to FIG. 11, by setting the distance d2 between the tip portion 751 of the supporting region RG and the read end portion 732 of the supporting member 712 to be 1.5 mm or more, the welding position can be kept away from the rear end portion 732 of the supporting member 712, in the case of fixing by spot welding, so that it is easy to weld uniformly. In addition, peeling of the supporting member 712 from the holding member 713 and breakage of the supporting member 712 can be prevented.

That is, when the contact pressure P1 is added from the photoconductor 1 to the contacting member 711, the force P3 with the tip portion 751 of the supporting region RG as fulcrum P is added to the read end portion 732 of the supporting member 712, according to the lever principle. A reaction force P4 of force P3 is added to the supporting region RG. When the distance d2 is less than 1.5 mm, the reaction force P4 becomes larger than the force due to the contact pressure P1, and the possibility of peeling or breakage of the supporting member 712 increases. Therefore, by setting the distance d2 to 1.5 mm or more, it is possible to suppress an increase in the reaction force P4 and to prevent peeling of the supporting member 712 from the holding member 713 and breakage of the supporting member 712. In particular, when the supporting member 712 is fixed to the holding member 713 by adhesion, by setting the distance d2 to 1.5 mm or more, it is possible to ensure the supporting region RG with a large area. Therefore, the supporting member 712 can be securely fixed to the holding member 713.

Furthermore, when the supporting member 712 is fixed by spot welding, by setting the interval d3 of each of the plurality of welded parts 715 along the longitudinal direction of the cleaning blade 71 to 2 mm or more, it is possible to suppress occurrence of waving in the supporting member 712 and to make the distribution of the contact pressure to the holding member 713 of the supporting member 712 uniform. By setting the distance d3 to 10 mm or less, it is possible to prevent the contact pressure of the non-welded portion from decreasing, and it is possible to make the distribution of the contact pressure to the holding member 713 of the supporting member 712 uniform.

Second Embodiment

Figure 12A:
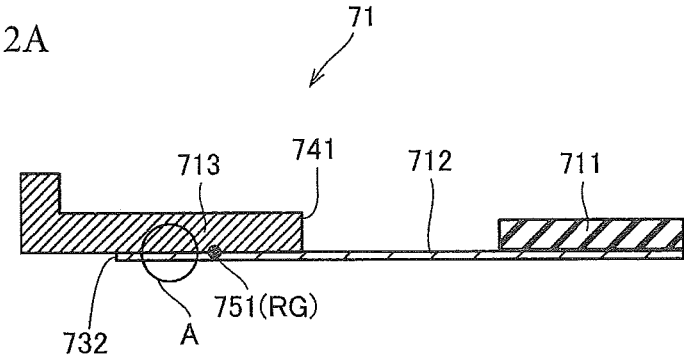
FIG. 12A is a cross-sectional view showing a configuration of a cleaning blade 71 according to a second embodiment of the present invention.
Figure 12B:
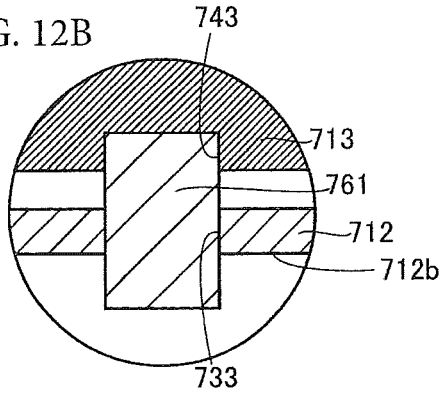
FIG. 12B is an enlarged view showing one configuration of part A in FIG. 12A.
Figure 12D:
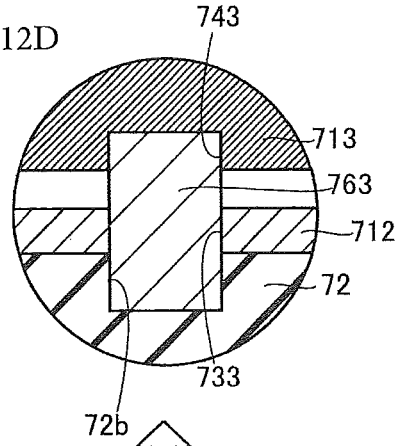
FIG. 12D is an enlarged view showing still another configuration of part A in FIG. 12A.
Figure 12C:
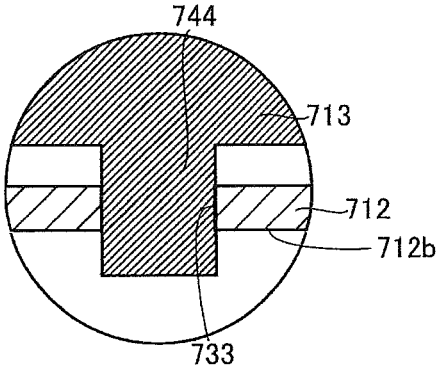
FIG. 12C is an enlarged view showing another configuration of part A in FIG. 12A.
Figure 12E:
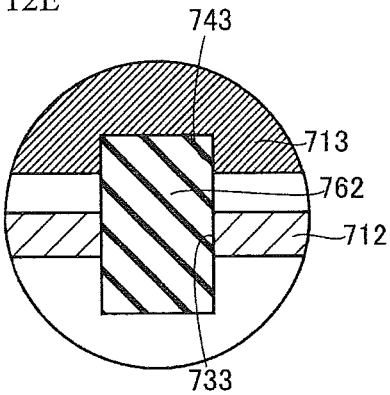
FIG. 12E is an enlarged view showing the manufacturing method of the structure of FIG. 12D.

FIG. 12A through FIG. 12E are cross-sectional views showing a configuration of a cleaning blade 71 according to a second embodiment of the present invention. FIG. 12A is a view showing the entirety of the cleaning blade 71. FIG. 12B is an enlarged view showing one configuration of part A in FIG. 12A. FIG. 12C is an enlarged view showing another configuration of part A in FIG. 12A. FIG. 12D is an enlarged view showing still another configuration of part A in FIG. 12A. FIG. 12E is an enlarged view showing the manufacturing method of the structure of FIG. 12D. In FIGS. 12A through 2E, the supporting member 712 is shown not deflected for convenience of explanation. In FIG. 12D, a portion of the housing 72 to which the cleaning blade 71 is fixed is further shown.

Referring to FIG. 12A through FIG. 12E, in the cleaning blade 71 of the present embodiment, each of the supporting member 712 and the holding member 713 includes a positioning portion for positioning the supporting member 712 and the holding member 713, between the tip portion 751 of the supporting region RG and the read end portion 732 of the supporting member 712.

Specifically, as shown in FIG. 12B, the supporting member 712 includes a through hole 733, and the holding member 713 includes a concave portion 743. The through hole 733 and the concave portion 743 are provided at positions overlapping each other, when viewed from the lower side of the cleaning blade 71. Upon alignment of the supporting member 712 and the holding member 713, the manufacturer of photoconductor cleaning unit 7 holds supporting member 712 and holding member 713 so that through hole 733 and concave portion 743 overlap each other. The manufacturer inserts the insertion 761 made of a pin, a dowel, etc. from the bottom into the through hole 733 and the concave portion 743. In the case where the position of the insertion 761 overlaps with the position fixed to the housing 72 of the cleaning blade 71, it is preferable to provide a concave portion at the upper surface of the housing 72, which engages with the lower end of the insertion 761, in order to avoid interference between the upper surface of the housing 72 and the lower end of the insertion 761.

Further, as shown in FIG. 12C, the supporting member 712 may include the through hole 733, and the holding member 713 may include the convex portion 744. The through hole 733 and the convex portion 744 are provided at positions overlapping each other, when viewed from the lower side of the cleaning blade 71. Upon alignment of the supporting member 712 and the holding member 713, the manufacturer of the photoconductor cleaning unit 7 holds the supporting member 712 and the holding member 713, so that the through hole 733 and the convex portion 744 are fitted to each other. In the case where the position of the convex portion 744 overlaps the position of the cleaning blade 71 fixed to the housing 72, it is preferable that a concave portion that fits with the lower end of the convex portion 744 is provided on the upper surface of the housing 72, in order to avoid interference between the upper surface of the housing 72 and the lower end of the convex portion 744.

Further, in FIG. 12D, like the case of FIG. 12B, the supporting member 712 includes a through hole 733, and the holding member 713 includes a concave portion 743. The housing 72 includes a concave portion 72*b*. Insertion 763 consisting of a pin, a dowel, etc. is inserted in the through hole 733, the concave portion 743, and the concave portion 72*b*.

With reference to FIG. 12E, when aligning the supporting member 712 and the holding member 713, the manufacturer of photoconductor cleaning unit 7 holds supporting member 712 and holding member 713, so that through hole 733 and concave portion 743 overlap each other. The manufacturer of the photoconductor cleaning unit 7 inserts the production pin 762 from below from the through hole 733 and the concave portion 743. In this state, the manufacturer fixes the supporting member 712 and the holding member 713. After the fixing, the production pin 762 is removed.

With reference to FIG. 12D, when fixing the cleaning blade 71 to the housing 72, the manufacturer inserts the insertion 763 into the concave portion 72*b* for positioning of the housing 72 and the cleaning blade 71. The manufacturer fits the through hole 733 and the concave portion 743 to the portion protruding from the housing 72 at the insertion 763. In this state, the manufacturer fixes the cleaning blade 71 to the housing 72.

The configuration of the image forming apparatus in this embodiment other than the above is the same as the configuration of the image forming apparatus in the first embodiment. For this reason, the same members are denoted by the same reference numerals, and description thereof will not be repeated.

As described above, in the cleaning blade 71, the free length L is an important factor determining the contact pressure. The free length L is determined by the fixing position of the supporting member 712 with respect to the holding member 713. Therefore, it is important to improve the accuracy of the fixing position of the supporting member 712 with respect to the holding member 713. According to the present embodiment, the supporting member 712 and the holding member 713 are each provided with positioning portions. This makes it possible to improve the accuracy of the fixing position of the supporting member 712 with respect to the holding member 713, when the supporting member 712 is later fixed to the holding member 713 by welding, bonding, or the like. Further, the positioning portions are provided between the tip portion 751 of the supporting region RG and the read end portion 732 of the supporting member 712. Thereby, the contact force between the supporting member 712 and the holding member 713 can be maintained, as compared to the case where the positioning portions are provided between the tip portion 751 and the tip portion 741 of the holding member 713

Third Embodiment

In the following third and fourth embodiments, structures for fixing the cleaning blade 71 to the housing 72 will be described.

Figure 13:
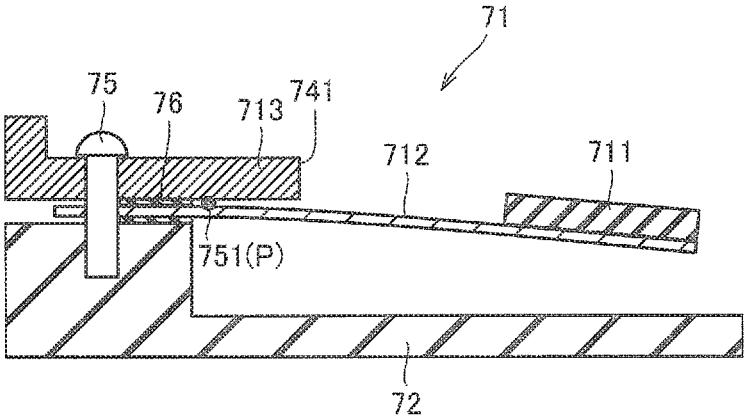
FIG. 13 is a cross-sectional view showing a configuration of a cleaning blade 71 and a housing 72 according to a third embodiment of the present invention.
Figure 14A:
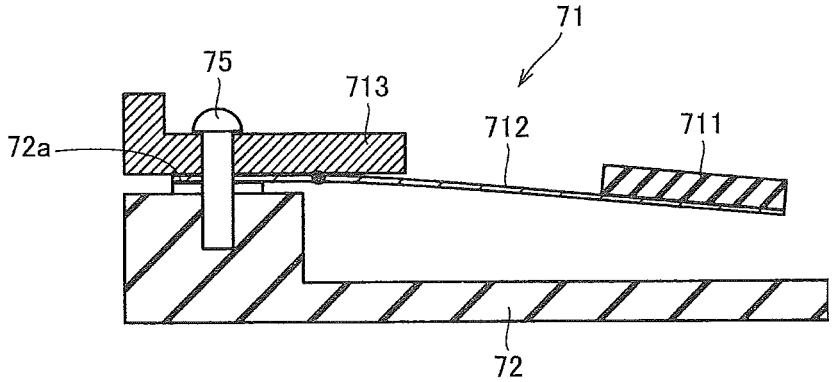
FIG. 14A, and FIG. 14B are a cross-sectional views showing a configuration of a cleaning blade 71 and a housing 72 according to a fourth embodiment of the present invention.
Figure 14B:
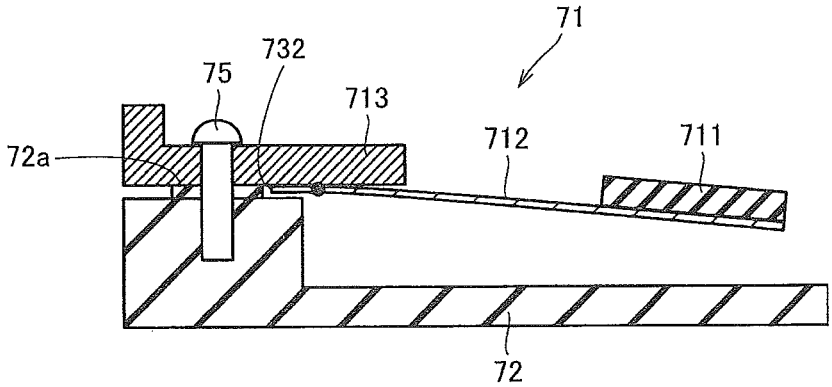

FIG. 13 is a cross-sectional view showing a configuration of a cleaning blade 71 and a housing 72 according to a third embodiment of the present invention. In FIG. 13, FIG. 14A and FIG. 14B, as for the housing 72, only the partial configuration is shown.

Referring to FIG. 13, the cleaning blade 71 in this embodiment is fixed to the housing 72 at the rear end side of the cleaning blade 71 than the tip portion 751 (that is, fulcrum P) of the supporting region RG. The cleaning blade 71 is fixed to the housing 72 with, for example, a screw 75. Thereby, it is possible to fix the cleaning blade 71 without hindering the deflection of the supporting member 712.

Between the cleaning blade 71 and the housing 72, a toner sealing member 76 is disposed. The toner sealing member 76 is compressed by the cleaning blade 71 and the housing 72 by tightening the screw 75. The toner sealing member 76 is preferably disposed between the tip portion 751 of the supporting region RG and the mounting position (the fastening position, or a mounting seat) of the screw 75. As a result, it is possible to prevent the accuracy of the position of the cleaning blade 71 from decreasing at the mounting position of the screw 75. Further, toner leakage from the screw hole can be suppressed, and scattering of the remaining toner from the inside of the housing 72 can be prevented.

The configuration of the image forming apparatus in this embodiment other than the above is the same as the configuration of the image forming apparatus in the first embodiment. For this reason, the same members are denoted by the same reference numerals, and description thereof will not be repeated.

Fourth Embodiment

FIG. 14A and FIG. 14B are a cross-sectional views showing a configuration of a cleaning blade 71 and a housing 72 according to a fourth embodiment of the present invention. FIG. 14A is a cross-sectional view showing one configuration of the cleaning blade 71 and the housing 72 in the fourth embodiment of the present invention. FIG. 14B is a cross-sectional view showing another configuration of the cleaning blade 71 and the housing 72 according to the fourth embodiment of the present invention. In FIG. 14A and FIG. 14B, the illustration of the toner sealing member 76 is omitted.

Referring to FIG. 14A and FIG. 14B, the housing 72 includes a mounting surface 72*a* (an example of a contacting surface) which is a plane on which the cleaning blade 71 is mounted. The housing 72 contacts the cleaning blade 71 at the mounting surface 72*a*. The mounting surface 72*a* is for enhancing the accuracy of the position (mounting height) and angle (mounting angle) of the cleaning blade 71, when the cleaning blade 71 is fixed to the housing 72.

The housing 72 may be in contact with the supporting member 712 on the entire mounting surface 72*a* as shown in FIG. 14A. Also, as shown in FIG. 14B, the housing 72 may not be in contact with the supporting member 712 and may be in contact with the holding member 713 on the entire mounting surface 72*a*.

The configuration of the image forming apparatus in this embodiment other than the above is the same as the configuration of the image forming apparatus in the first and third embodiments. For this reason, the same members are denoted by the same reference numerals, and description thereof will not be repeated.

According to the present embodiment, it is possible to avoid contact of the housing 72 with the cleaning blade 71 at the step portion made by the read end portion 732 of the supporting member 712 and the holding member 713. As a result, the step portion made by the read end portion 732 of the supporting member 712 and the holding member 713 does not lower the accuracy of the position and angle of the cleaning blade 71. It is possible to prevent deterioration of the mounting accuracy of the cleaning blade 71.

Example

The present inventors conducted the following experiments to evaluate the performance of the contacting device of the present invention.

A drum unit (a unit including a photoconductor) in an MFP having a product name "Bishub C284e" manufactured by Konica Minolta is prepared. As a cleaning blade of the photoconductor cleaning unit of this drum unit, a new cleaning blade of the present invention example (having the structure shown in FIG. 4) or a comparative example (having the structure shown in FIG. 6) was used. As the photoconductor of the drum unit, three kinds of photoconductors with different surface friction coefficients were used. The free length L, which is the distance from the fulcrum to the tip end part of the supporting member at the time when the rotation of the photoconductor stopped, was 14 mm. Other conditions for the experiment are shown in FIG. 15

In an environment with high temperature and high humidity (temperature 30 degrees Celsius, and humidity 85%) which is a harsh environment for torque rise, the photoconductor was rotationally driven using an external driving jig. Torque at rotation drive of the photoconductor was measured using a torque converter. The measured torque was regarded as the contact pressure of the photoconductor and the cleaning blade, and was evaluated.

That is, where T is the torque, r is the radius of the photoconductor (image carrying member), and F is the force applied to the photoconductor when the photoconductor is rotated and driven, it is "T=r*F". The force F is proportional to the contact pressure of the photoconductor and the cleaning blade. That is, where the surface friction coefficient of the photoconductor is and the contact pressure is N, then "F=μN" and "T=rμN".

Figure 16:
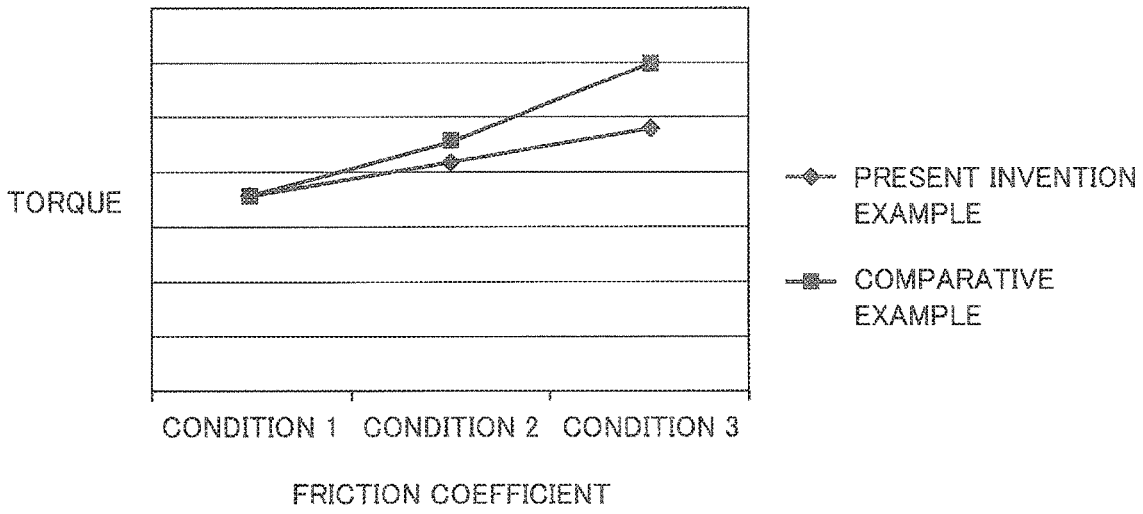
FIG. 16 is a graph showing the relationship between the surface friction coefficient of a photoconductor and torque in an embodiment of the present invention.

FIG. 16 is a graph showing the relationship between the surface friction coefficient of a photoconductor and torque in an embodiment of the present invention. In FIG. 16, the condition 1, the condition 2, and the condition 3 mean a case where a photoconductor having a small surface friction coefficient was used, a case where a photoconductor having a medium friction coefficient was used, and a case where a photoconductor having a large surface friction coefficient was used, respectively.

Referring to FIG. 16, a relationship of "T=rμN" holds between the torque T and the surface friction coefficient μ of the photoconductor. Therefore, in both the present invention example and the comparative example, the torque increases as the surface friction coefficient of the photoconductor increases. Also, in the case of using a photoconductor having the same surface friction coefficient, comparing the example of the present invention and the comparative example, the torque in the example of the present invention was smaller than the torque in the comparative example. From this fact, it can be inferred that in the example of the present invention, the fluctuation of the contact pressure to the photoconductor can be reduced and the load on the motor driving the photoconductor can be reduced as compared with the comparative example.

In the comparative example, as the surface friction coefficient of the photoconductor increased, the torque remarkably increased. In contrast, according to the present invention, an increase in the torque against the increase in the surface friction coefficient of the photoconductor was suppressed. From this, it can be inferred that in the example of the present invention, increase in the contact pressure to the photoconductor can be suppressed regardless of the state of the surface of the photoconductor, and the decrease in lifetime of the photoconductor can be suppressed.

This result shows that suppressing the increase in torque is the same as suppressing the force applied to the supporting member of the cleaning blade. Therefore, peeling or breakage of the supporting member is suppressed even under the environment of the assumed load and the assumed coefficient of friction by the constitution of the present invention example.

As shown in FIG. 16, the torque fluctuates due to the surface friction coefficient of the photoconductor. The torque also fluctuates according to the conditions such as the hardness of the urethane used as the contacting member, the condition of wear of the contacting member and the photoconductor, the rotation speed of the photoconductor, and the adhesion state of the toner to the photoconductor. Therefore, it is important to suppress the fluctuation (variation) of torque.

[Others]

FIG. 17A through FIG. 17D are a cross-sectional view showing a configuration of a modification of the cleaning blade 71 according to the embodiment of the present invention.

Figure 17A:
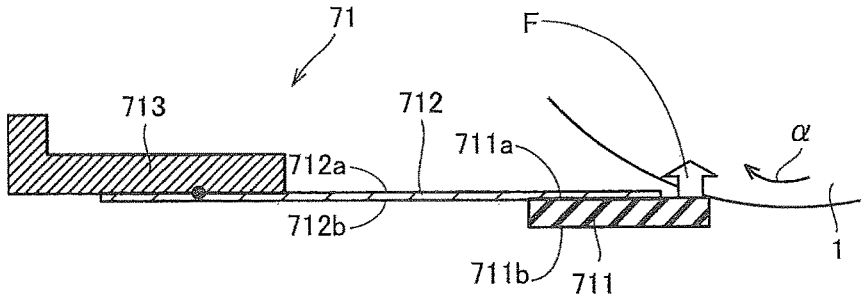
FIG. 17A through FIG. 17D are cross-sectional views showing a configuration of a modification of the cleaning blade 71 according to the embodiment of the present invention.

Referring to FIG. 17A through FIG. 17D, contacting member 711 may protrude distally from supporting member 712 as shown in FIG. 17A. The contacting member 711 may abut the photoconductor 1 at the upper surface 711*a*, and be supported on the lower surface 712*b* of the supporting member 712, at the upper surface 711*a*.

Figure 17B:
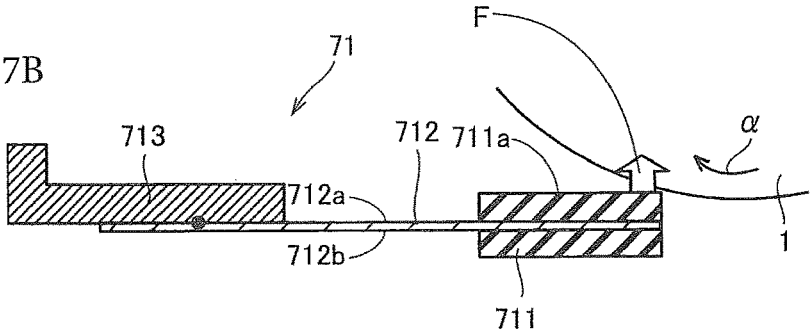

In addition, as shown in FIG. 17B, the supporting member 712 may be inserted inside the contacting member 711. The contacting member 711 may be supported by the supporting member 712 on both the upper surface 712*a* and the lower surface 712*b* of the supporting member 712.

Figure 17C:
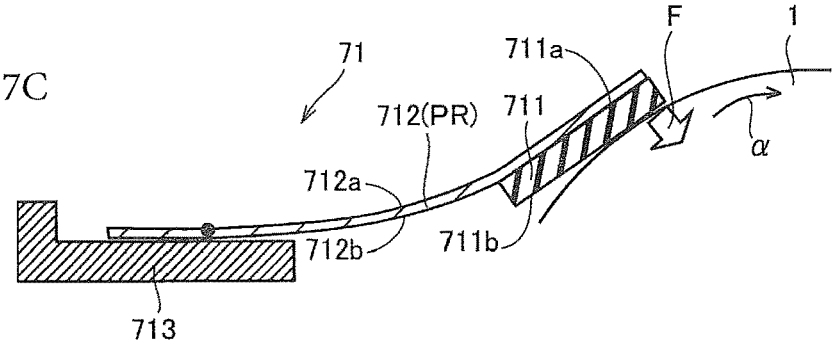
Figure 17D:
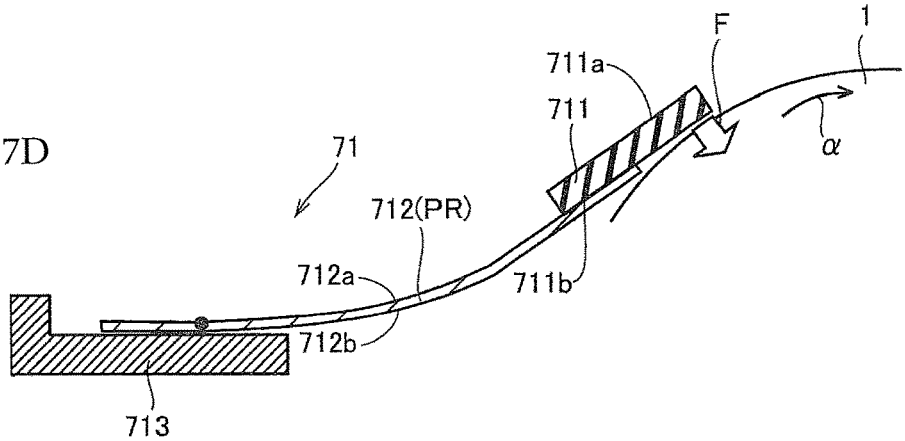

Further, as shown in FIG. 17C and FIG. 17D, the protruding part PR of the supporting member 712 may protrude from the holding member 713 in the same direction as the rotating direction of the photoconductor 1 (the direction indicated by the arrow α). The contacting member 711 may be in contact with the photoconductor 1 at the lower surface 711*b*. The supporting member 712 may be held by a holding member 713 on the upper surface 713*a*. In this case, the contacting member 711 may be supported on the lower surface 712*b* of the supporting member 712 at the upper surface 711*a*, as shown in FIG. 17C. As shown in FIG. 17D, the contacting member 711 may be supported by the upper surface 712*a* of the supporting member 712 at the lower surface 711*b*.

Further, the cleaning blade 71 according to the second to fourth embodiments may have the configuration of the modification shown in FIG. 17A through FIG. 17D.

The cleaning blade 71 in the above embodiment is mounted in a photoconductor cleaning unit 7, for removing adhering substances adhering to the photoconductor 1. In addition to this case, the cleaning blade 71 may be mounted on an intermediate transfer belt cleaning unit 9, for removing adhering substances adhering to the intermediate transfer belt 5. Further, the cleaning blade 71 in the above-described embodiment may be one to apply lubricant to an image carrying member, by abutting the image carrying member such as photoconductor 1 and intermediate transfer belt 5.

The above embodiments and modifications can be combined with each other.

Although the present invention has been described and illustrated in detail, the disclosed embodiments are made for purposes of illustrated and example only and not limitation. The scope of the present invention being interpreted by terms of the appended claims.

Effect of Embodiment

According to the present embodiment, it is possible to provide a contacting device capable of reducing the fluctuation of the contact pressure abutting against the rotating body, and an image forming apparatus including the contacting device.

What is claimed is:

1. A contacting device abutting a rotating body comprising:

a contacting unit which abuts the rotating body, a supporting unit for supporting the contacting unit, the supporting unit having a first supporting surface and a second supporting surface opposite the first supporting surface; and a holding unit for holding the supporting unit, wherein the supporting unit supports the contacting unit by a protruding part which protrudes from the holding unit, the holding unit includes a first surface, and a second surface existing on the opposite side of the first surface, a tip portion extending between the first surface and the second surface disposed closest to the contacting unit, and a rear end portion disposed opposite to the tip portion;

the holding unit holds the first supporting surface or the second supporting surface of the supporting unit in a supporting region on the second surface, the supporting region disposed at a distance apart from the tip portion of the holding unit between the tip portion and the rear end portion; and a distance between a distal end of the supporting region closest to the contacting unit and a rear end portion of the supporting unit furthest from the contacting unit is 1.5 mm or more.

2. The contacting device according to claim 1, wherein the contacting unit includes an abutting surface which is a surface abutting against the rotating body, and a supporting surface which is present on an opposite side of the abutting surface and is supported by the supporting unit.

3. The contacting device according to claim 1, wherein the supporting unit has Young's modulus of 98 GPa or more and 206 GPa or less.

4. The contacting device according to claim 1, wherein the supporting unit has a thickness of 50 μm or more and 100 μm or less.

5. The contacting device according to claim 1, wherein each of the supporting unit and the holding unit includes a positioning portion for positioning of the supporting unit and the holding unit, between a distal end of the supporting region closest to the contacting unit and a rear end portion of the supporting unit furthest from the contacting unit.

6. The contacting device according to claim 1, wherein the supporting unit is fixed by welding to the holding unit in the supporting region.

7. The contacting device according to claim 6, wherein the distance between a distal end of the supporting region closest to the contacting unit and the tip portion of the holding unit is 1.5 mm or more.

8. The contacting device according to claim 6, wherein the supporting unit is fixed by welding to the holding unit at a plurality of locations, and an interval among the plurality of locations along a direction orthogonal to the protruding direction is 2 mm or more and 10 mm or less.

9. The contacting device according to claim 1, wherein the supporting unit is fixed by adhesion to the holding unit in the supporting region.

10. The contacting device according to claim 1, wherein the supporting unit deflects with a distal end of the supporting region closest to the contacting unit as a fulcrum, by a force received from the rotating body.

11. The contacting device according to claim 1, wherein the contacting unit abuts against the rotating body to remove adhering substances adhering to the rotating body.

12. The contacting device according to claim 11, wherein the rotating body is an image carrying member.

13. The contacting device according to claim 1, wherein the rotating body is an image carrying member, and the contacting unit abuts the image carrying member to apply a lubricant to the image carrying member.

14. An image forming apparatus comprising:

the rotating body, the contacting device according to claim 1, and a housing for fixing the contacting device, wherein the contacting device is fixed to the housing at a rear end side with respect to a distal end of the supporting region nearest the contacting unit.

15. The image forming apparatus according to claim 14, wherein the protruding part protrudes from the holding unit in a direction opposite to the rotating direction of the rotating body.

16. The image forming apparatus according to claim 14, further comprising a seal member provided between the contacting device and the housing, so as to be compressed between the contacting device and the housing at the rear end side of the distal end of the supporting region.

17. The image forming apparatus according to claim 16, wherein the contacting device is screwed to the housing, and the seal member is provided at a distal end of an attachment position of the screw.

18. The image forming apparatus according to claim 14, wherein the housing includes a contacting surface that is an area in contact with the contacting device, and the housing contacts the supporting unit on the entire contacting surface, or the housing does not contact the supporting unit.

* * * * *